US007234333B2

(12) United States Patent
Maier et al.

(10) Patent No.: US 7,234,333 B2
(45) Date of Patent: Jun. 26, 2007

(54) MACHINE FOR BENDING ROD-SHAPED OR TUBULAR WORKPIECES

(75) Inventors: Werner Maier, Reutlingen (DE); Jurgen Wolf, Walddorfhaslach (DE); Frank Hacker, Riederich (DE); Patrick Schlund, Reutlingen (DE); Dieter Geisel, Pfullingen (DE); Dietmar Sautter, Lichtenstein (DE)

(73) Assignee: Wafios Aktiengesellschaft, Reutlingen (DE)

( * ) Notice: Subject to any disclaimer, the term of this patent is extended or adjusted under 35 U.S.C. 154(b) by 146 days.

(21) Appl. No.: 11/088,102

(22) Filed: Mar. 23, 2005

(65) Prior Publication Data

US 2005/0210945 A1 Sep. 29, 2005

(30) Foreign Application Priority Data

Mar. 26, 2004 (EP) ..... 04007328

(51) Int. Cl.
*B21D 9/05* (2006.01)
*B21D 7/04* (2006.01)

(52) U.S. Cl. ..... 72/156; 72/150

(58) Field of Classification Search ..... 72/149, 72/150, 154, 156–159
See application file for complete search history.

(56) References Cited

U.S. PATENT DOCUMENTS 4,760,727 A 8/1988 Van Landingham

FOREIGN PATENT DOCUMENTS

WO WO 2004/000479 A1 12/2003

*Primary Examiner*—Lowell A. Larson
*Assistant Examiner*—Teresa M. Bonk
(74) *Attorney, Agent, or Firm*—Patterson, Thuente, Skaar & Christensen, P.A.

(57) ABSTRACT

On a machine for bending rod-shaped or tubular workpieces, which includes a bending head having a bending mandrel mounted on a rotational axis and rotatable by means of a rotary drive, and having a clamping device for pressing the workpiece to be bent against a forming groove on the bending mandrel and also a feeding device for the workpiece to be processed, whereby the clamping device is positionable relative to the bending mandrel and can is also pivotable concentrically to the rotational axis of the bending mandrel, the clamping device is attached to two mutually independent rotary drives, one of which performs its pivoting movement about the rotational axis of the bending mandrel, and via the other of which it can be moved with respect to the bending mandrel by using an interposed conversion transmission that converts a rotary motion to a linear motion, whereby the bending head includes three concentrically nested rotary shafts for transmitting the drive of the three rotary drives to the bending mandrel, to the conversion transmission and to the clamping device, each of which is connected to one of the rotary drives.

18 Claims, 9 Drawing Sheets

MACHINE FOR BENDING ROD-SHAPED OR TUBULAR WORKPIECES

FIELD OF THE INVENTION

The present invention relates to a machine for bending rod-shaped or tubular workpieces, whereby the bending apparatus includes a bending head having a bending mandrel mounted on a rotational axis and rotatable by means of a rotary drive, and having a clamping device for pressing the workpiece to be bent against a forming groove on the bending mandrel, whereby the bending head also has a feeding device for the workpiece to be processed, and the clamping device is positionable relative to the bending mandrel and is also pivotable concentrically to the rotational axis of the bending mandrel.

BACKGROUND OF THE INVENTION

Such bending apparatus are used in modern bending machines for rod-like workpieces and for prefabricated conduits primarily having larger cross sections.

In such cases the bending apparatus constitutes a plurality of units whose interaction makes good bending results possible, especially in the case of tubular workpieces with thin walls.

A bending apparatus should ideally be able to satisfy a majority of particular requirements in that it should be able to perform the following functions: right-hand and left-hand bending, draw bending and curling, coiling, producing a bend directly after a different bend without an intervening straight segment, producing bends with different radii, bending pipes of different diameters, preventing wrinkling, three-dimensional bending, and enabling simple retooling.

Bending devices are known with bending heads that must be e.g. pivoted to convert from left to right coiling (see EP 1 226 887 B1, EP 1 291 094 B1 and EP 1 350 578 A1), or which are constructed symmetrically (WO 03/053 606 A1). Likewise, the possibility of exchanging a bending head for such a conversion is also known.

Also prior art is the use of multi-stage dies for producing different bending radii and for processing workpieces of different diameters, as well as the use of forming jaws for producing sequential bends without an intervening straight segment (see EP 1 350 578 A1 and WO 03/053 606 A1). The use of a slide rail to support and track the material is also known (see EP 1 291 094, EP 0 963 800 B1 und U.S. Pat. No. 6,651,475).

WO 2004/000479 A1 describes a bending apparatus of the type named at the beginning that can be used both for left-hand and for right-hand bending, without the bending mandrel having to be changed. It is essentially circular in design and has two circular forming grooves arranged on it that are axially offset from one another, one of which is used for left-hand bending and the other for right-hand bending. However, positioned on each of the forming grooves, at the place where the free end of the bent pipe again emerges tangentially from the ring groove when bending pipe, is a corresponding forming piece that itself has a straight-line forming segment that branches off tangentially from the corresponding forming groove, so that an end piece of the pipe to be bent that diverges in a straight line tangentially from the bend lies in this section of the forming groove. For bending, the pipe delivered by a feed device is placed and pressed against the corresponding forming groove section of the forming piece that diverges tangentially from the forming groove in question, by means of a clamping device that can be moved relative to the bending mandrel, after which, when the pipe is clamped in place, the clamping device is pivoted together with the bending mandrel concentrically to the rotational axis of the latter, until behind the straight-line section of the forming groove, in the adjacent ring groove, the pipe is bent accordingly during the rotation. The clamping device is then separated from the bending mandrel, and the bent area of the bent pipe is removed from the forming groove of the bending mandrel and its straight-running end area is removed from the forming groove section of the forming piece.

If the same pipe is then to receive e.g. another bend in the other direction, which is to be e.g. directly adjacent to the first bend, the piece of pipe that has already been bent is moved to the other side of the bending mandrel, to the elevation of the other forming groove on the bending mandrel. At the same time, the clamping device is pivoted about the rotational axis of the bending mandrel relative to the latter so that it is positioned on the other side of the mandrel, and the pipe is again present between it and the bending mandrel. The pipe is then re-clamped between the clamping device and the bending mandrel (there again in a forming piece mounted correspondingly on the other forming groove, having a segment of forming groove that runs in a straight line, emerging tangentially from the forming groove of the bending mandrel), and the new bend in the pipe is then produced by rotating both the clamping device and the bending mandrel about the rotational axis of the bending mandrel, this time in the opposite direction.

Since there are two forming grooves on the bending mandrel, axially offset to one another, for left-hand and right-hand bending, each of which has an associated fitting with the straight-line segment of forming groove, and since (because of the difference in bending direction) the two fittings protrude linearly from the bending mandrel in opposite directions, albeit by different amounts, accordingly the clamping device, since in each of its pivoted positions for the two bending directions it must cooperate with one of the forming grooves and the associated forming segment at different heights, must also have forming grooves positioned corresponding to the difference in level to press the pipe against the bending mandrel and its forming segments. This requires geometrically that the corresponding forming grooves, as well as the fittings on the bending mandrel, must also be adjacent to one another, which results in a complicated structure and a relatively great width of the clamping device, but which is not favorable in view of the desired compact construction of such bending devices. The same is also true of the wrinkle smoother utilized there in the form of relatively long guide strips immediately upstream of the clamping device in the feeding direction of the pipe, with a corresponding forming groove for placing the wire. Here too, because of the difference in height of the forming grooves on the bending mandrel with respect to left-hand and right-hand bending, two different smoothing strips must be used that point in opposite directions, where each embodies a forming groove, and that must also be moved by corresponding travel distances next to the sliding mandrel. This too takes up more space than desired. The publication says nothing about how the movement of the clamping device relative to the bending mandrel is realized, but it can be seen from the illustrative figures in the publication that a shifting occurs along a guide strip that is mounted on the underside of the clamping device and is overlapped and positively gripped by the latter, for which it is quite obvious that a linear drive must be used, although this is not described in further detail there.

Starting from this basis, the object of the invention is now to improve such a bending device such that the clamping device gets by with an especially small space requirement and a separate linear positioning motor is not needed for the linear movement of the clamping device.

SUMMARY OF THE INVENTION

This is accomplished according to the present invention in a bending apparatus of the type named at the beginning in that the clamping device is attached to two mutually independent rotary drives, one of which performs its pivoting movement about the rotational axis of the bending mandrel, and via the other of which it can be moved with respect to the bending mandrel using an interposed conversion transmission that converts a rotary motion to a linear motion, whereby the bending mandrel includes three concentrically nested rotary shafts for transmitting the force from the three rotary shafts to the bending mandrel, to the conversion transmission and to the clamping device, each of which is connected to one of the rotary drives.

Preferably the innermost rotary shaft carries the bending mandrel, which is mounted at the very top of the bending head, while—again preferably—the middle rotary shaft drives the conversion transmission, which is mounted on the bending head below the bending mandrel, to produce the linear motion for the clamping device, whereby the outermost rotary shaft is preferably connected rotationally fixed to a supporting plate that is positioned below the conversion transmission, on which plate the clamping device is mounted such that it can be moved in one direction toward the bending mandrel.

With the bending device according to the present invention, having the linear adjusting motion of the clamping device also derived from a rotary drive (using an interposed conversion transmission) creates the option of transmitting force from the three rotary drives to the desired parts via three concentrically nested rotary shafts, and thereby achieving an especially compact overall design for the bending head, whereby it is not difficult to realize the integration of such a conversion transmission into the overall construction of the three concentric shafts within the framework of the bending head. The necessity of using a separate linear drive that must be mounted separately on the outside is avoided. The motors for the three rotary drives are activated for example using a program control unit, whereby the rotary motion can be converted especially quickly and precisely via the conversion transmission to the linear motion of the clamping device relative to the mandrel. At the same time, it is possible to set a desired pressing force with which the clamping device presses the pipe against the forming groove in the bending mandrel without any problem.

The conversion transmission can be of any suitable constructional design. Especially preferred however is for the conversion transmission to include a disk cam containing a groove that runs eccentrically to its axis of rotation, which is engaged by a formed piece that conforms to the cross section of the groove and is attached to the clamping device, which can be shifted in the groove, and whose distance from the axis of rotation of the disk cam can be changed by turning the disk cam. That makes it possible, in conjunction with a type of linkage guide, to quickly bring about a corresponding linear adjustment motion of the clamping device through the rotary movement of the disk cam, whereby the drive is not only very compact, but the adjustment motions can also be carried out especially quickly.

At the same time, the clamping device preferably has a holding device which is affixed to the disk cam so that they rotate together, as well as a tensioning block that is borne so that it can slide in a linear guide that is mounted on the holding device, and to which the formed piece that engages the groove in the disk cam is attached. This results in a very effective and yet simple design for the conversion transmission.

At the same time, the tensioning block is advantageously provided with an interchangeable attached clamping jaw, in which there is a forming groove that corresponds to the position of the forming groove in the bending head and that matches the shape of the workpiece that is to be clamped. As a result, when the workpiece to be bent is changed, the shape of the forming groove can easily be adapted to its changed shape dimensions by merely changing the clamping jaw.

Especially preferred here is for the tensioning block to be attached to a holding element that carries the formed piece via it and engage the linear guide, where, again preferably, this holding element in turn sits on a carrier piece to which it is attached in such a way that it can be shifted in a direction perpendicular to the alignment of the linear guide, and on which the formed piece is mounted so that it has a sliding engagement with the linear guide. Especially preferred is for the holding element to be attached to a drive device on the carrier piece, for moving it with respect to the latter.

This achieves all-in-all a very compact overall construction for the clamping device, which is also accompanied by a very small space requirement.

Especially recommended with a bending apparatus according to the present invention is for there to also be a wrinkle smoother immediately upstream of the clamping device, when viewed in the feed direction of the workpiece, by which wrinkling of the workpiece to be bent can be prevented in the area of the workpiece directly upstream of the bend. That prevents the material to be bent, e.g. tubing, from wrinkling or tearing during the bending process. Any suitable design can be used for the wrinkle smoother, but it is especially preferable for it to have slip jaws that can be placed in contact with the workpiece that is to be bent.

For controlling the three different rotary drives and possible additional drive devices (e.g. for positioning the holding element on the carrier piece), it is advantageous to provide a program control device.

Another preferable design of the bending device according to the present invention also consists in providing an additional drive device by which the bending head can be moved in two directions that are perpendicular to one another and both of which are perpendicular in turn to the feed direction of the workpiece to be bent, which results in the possibility of lowering the bending head below the pipe, which is held by a clamping head and protrudes from it (possibly already with a bend in the area of one of its ends) underneath it over to its other side, and then raising it again, in order to thereby bend the workpiece in the other bending direction, whereby in this case the clamping device merely has to be rotated by 180°, and the bending mandrel with the forming groove on its opposite side must be brought into the correct orientation to the side of the pipe which then faces it. With the exception of the lowering and lateral shifting movement and the raising of the bending head, everything else can be achieved with rotary motions of the bending mandrel or of the clamping device (about the same rotational axis as the bending mandrel), whereby the linear motion of the clamping device against the bending mandrel can then again be produced via the third rotary drive, as before (whereby it is only necessary to also rotate the conversion transmission to a position that is rotated by 180°).

Another advantageous embodiment of the bending apparatus according to the present invention also consists in there being, on the side of the workpiece where the clamping device is arranged, instead of a wrinkle smoother, a fixed guide roller that is placed upstream of the clamping device and that can be mounted such that it can also press against the corresponding side of the workpiece with a certain pressure, if desired.

Yet another preferred embodiment of the present invention also consists in having both the bending mandrel and the clamping jaw of the tensioning block designed in the form of a roller with a guide groove to be placed in contact with the facing side of the workpiece to be bent, which again results in a simplified design of the bending device according to the present invention, with an especially compact construction. If the wrinkle smoother, again preferably, then has at least two pressure rollers (instead of the sliders) arranged in sequence in the feed direction of the workpiece to be bent, a bending apparatus according to the present invention is then produced with which it is also possible to produce the desired bend in the coiling process. Depending on the position of the roller of the tensioning block relative to the bending mandrel, the bending radius produced in the workpiece can be changed continuously by the clamping device, which makes it possible to produce elliptical, oval or spiral-shaped bends.

Any suitable shape of bending mandrel can be used in the bending apparatus according to the present invention, such as e.g. in the shape of a circular roller with a corresponding circumferential forming groove. But it is especially preferred for the bending mandrel to be designed such that when viewed parallel to its pivoting axis it has a shape that is not rotationally symmetrical, but is symmetrical to a central axis that is perpendicular to the axis of rotation and passes through it, whereby the forming groove on the bending mandrel, for contacting one side of the workpiece to be bent, viewed relative to this longitudinal central axis, is also positioned symmetrically on both sides of the bending mandrel. One such embodiment results in an especially preferably usable bending mandrel that does not have to be rotated by some 180°, even when changing the bending direction, but rather only by a small angle. On the whole, the bending device according to the present invention is of very compact and space-saving design; it can be used readily for both right-hand and left-hand bending, while still always preserving the advantage that the rotary shafts for the bending mandrel, conversion transmission and clamping device can bring about the corresponding motions of these individual devices through pure rotary motions, and about a common central axis as well (because of the concentrically positioned transmission shafts). This permits especially rapid and precise control of the individual motions, independent of one another.

The bending device according to the present invention is constructed very compactly and permits great freedom of bending, namely both small intervals between successive bends and small intervals from the bends to the ends of the prefabricated pipe workpieces, making it possible to ensure gentle material handling. At the same time, the possibility also exists of constructing the utilized bending dies in multiple stages, so as to be able to form both different bending radii and pipe material of different diameters with a single die. The many degrees of freedom of the apparatus realized in the invention enable optimal adjustability to the particular circumstances, such as e.g. the pipe diameter, wall thickness, material, and bending radius.

BRIEF DESCRIPTION OF THE DRAWINGS

The principle of the invention will be explained in greater detail below by example on the basis of the drawing. The figures show the following:

FIG. 11: a top view of the bending head of FIGS. 8 through 10 with the clamping device moved into position, the bending mandrel aligned, and the wrinkle smoother moved in;

DETAILED DESCRIPTION OF THE INVENTION

Figure 13:
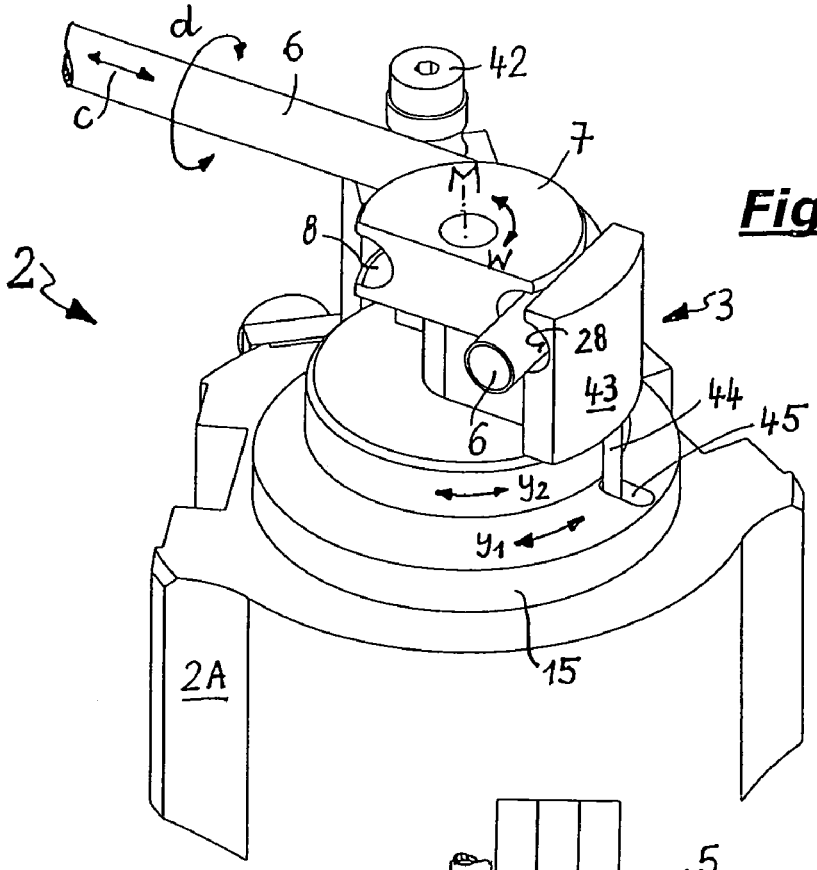
FIG. 13: an oblique perspective view to portray the principle of another embodiment of a bending head on a bending apparatus according to the present invention.
Figure 14:
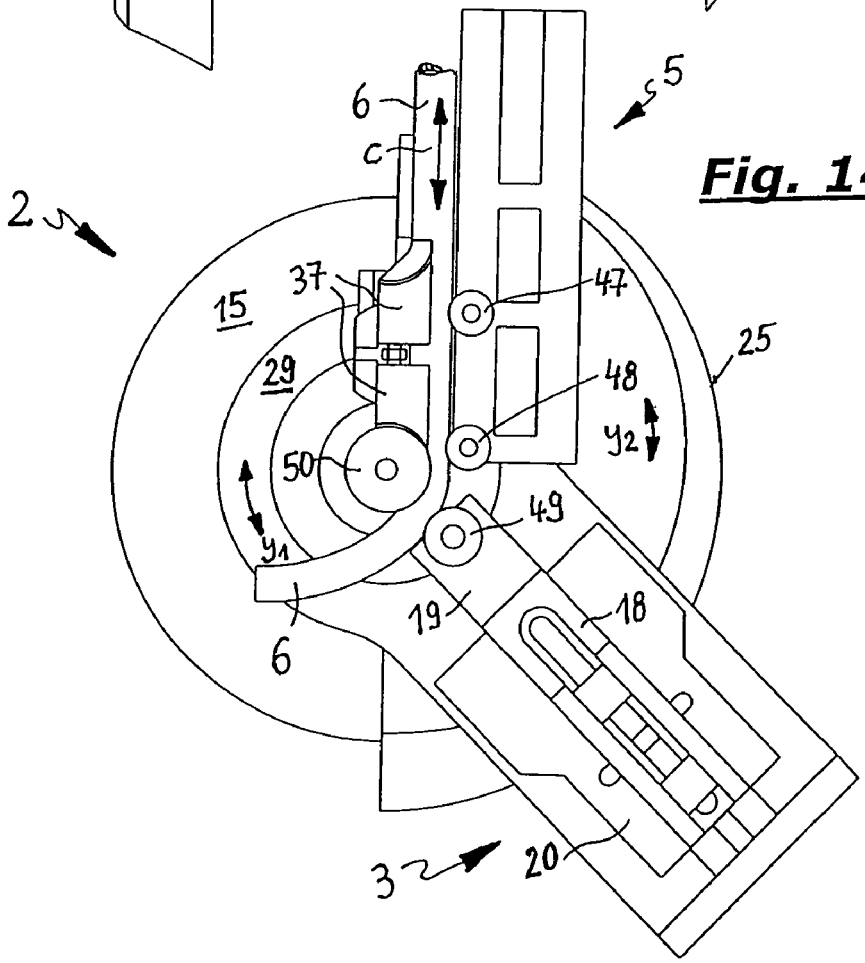
FIG. 14: a top view of yet another embodiment of a bending head on a bending apparatus according to the present invention that is suitable for producing the bending of the pipe workpiece by coiling.

In the following description of the figures, the portrayals in FIGS. 1 through 12 refer to a first, especially advantageous embodiment of a bending device, while FIG. 13 portrays (in oblique perspective view) a different embodiment of a bending head on such a bending apparatus, and FIG. 14 is a top view showing the principle of yet another embodiment of a bending head. In all of the figures, including when they relate to modified embodiments, the same reference symbols are used for the same parts.

We will first examine FIGS. 1 through 12, which portray a first embodiment of a bending apparatus.

Figure 1:
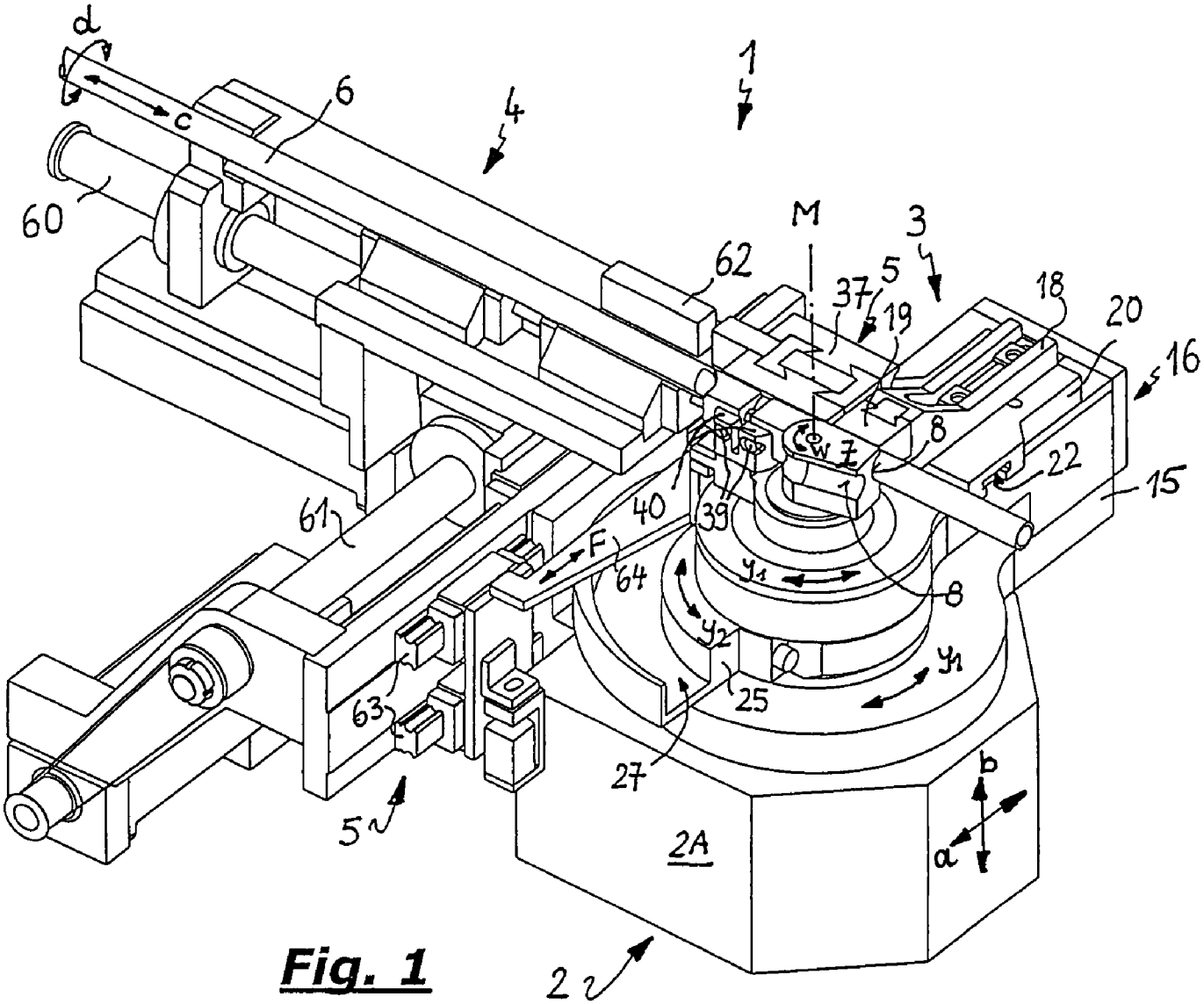
FIG. 1: an oblique perspective view of a bending device according to the present invention.
Figure 12:
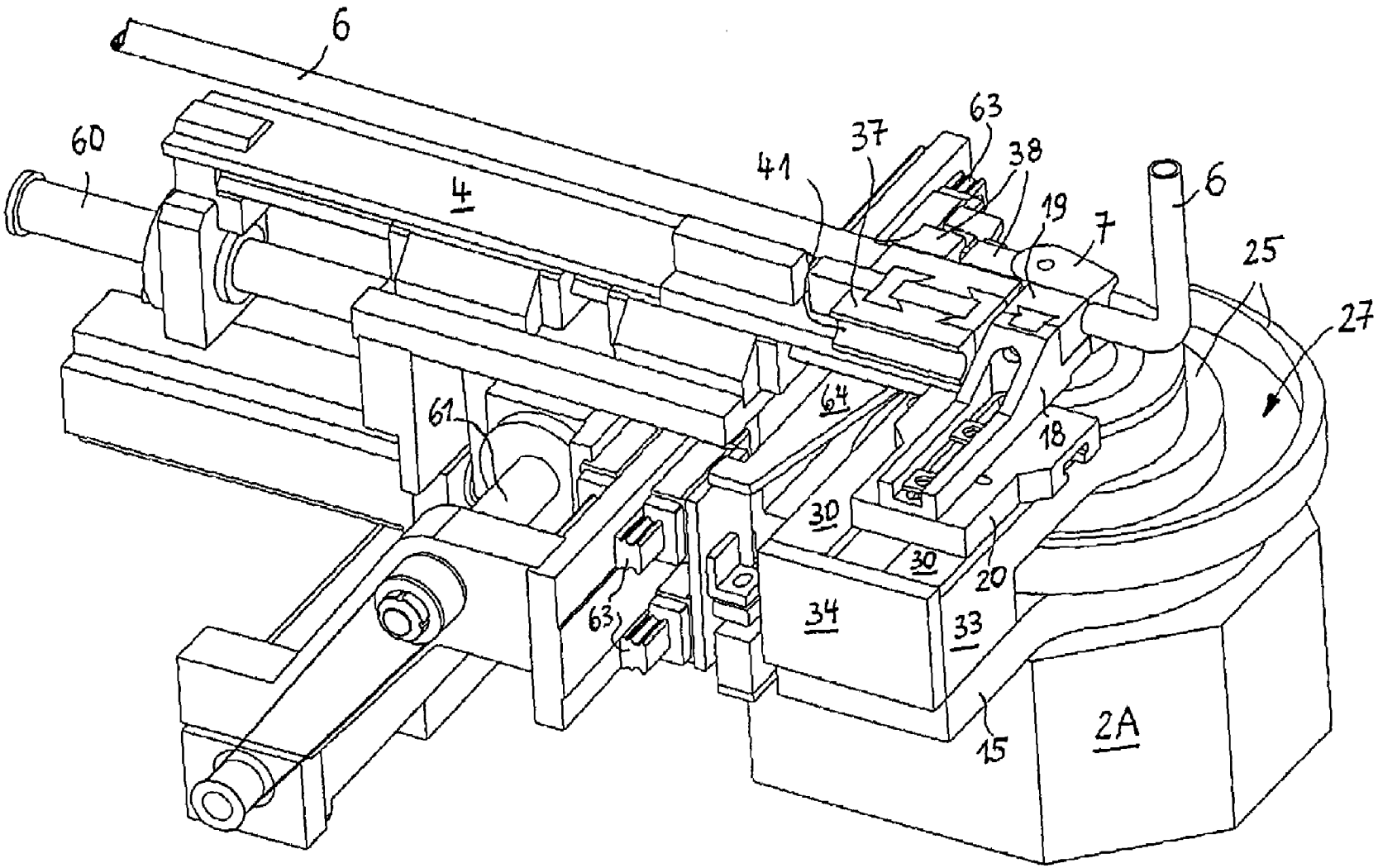
FIG. 12: an oblique perspective view of a bending device according to the present invention in the position shown in a top view in FIG. 11.

FIG. 1 shows a perspective view (obliquely from in front and above) of a bending device 1 shortly before a right-hand bend is executed, while FIG. 12 shows the same oblique perspective portrayal of the same bending apparatus 1, but in the starting state before a left-hand bending procedure.

As can be seen from FIG. 1, bending device 1 includes essentially three important devices, namely a bending head 2 (with a clamping device 3), also a slide rail 4 (as a feed device) and a wrinkle smoother 5. These three devices are used to produce bends in prefabricated conduits or pipes 6, in order to achieve good reshaping results without wrinkling or cracking on the pipe 6.

Bending apparatus 1 can travel in its entirety on a horizontal motion path a and a vertical motion path b by means of a suitable corresponding drive (which is however not depicted in the figures).

Bending head 2 comprises first of all a carrier body 2A, on top of which a bending mandrel 7 that can rotate about a central axis M is mounted. Lying against the side of the bending mandrel 7 is a tubular workpiece 6 (with a relatively thin wall) in a forming groove 8 that is formed on the bending mandrel and runs around three sides thereof, the shape of the groove being matched to the shape of the pipe 6. Pipe 6 is fed in direction c by a transport device (not portrayed in the figures), from which it emerges through a clamping jaw (also not portrayed in the figures), but by means of which it can be held in a particular fixed position at any time. It is also possible by means of the feed device and the clamping jaw to rotate the pipe 6 around its longitudinal axis in direction d, and in fact in both directions of rotation.

Figure 2:
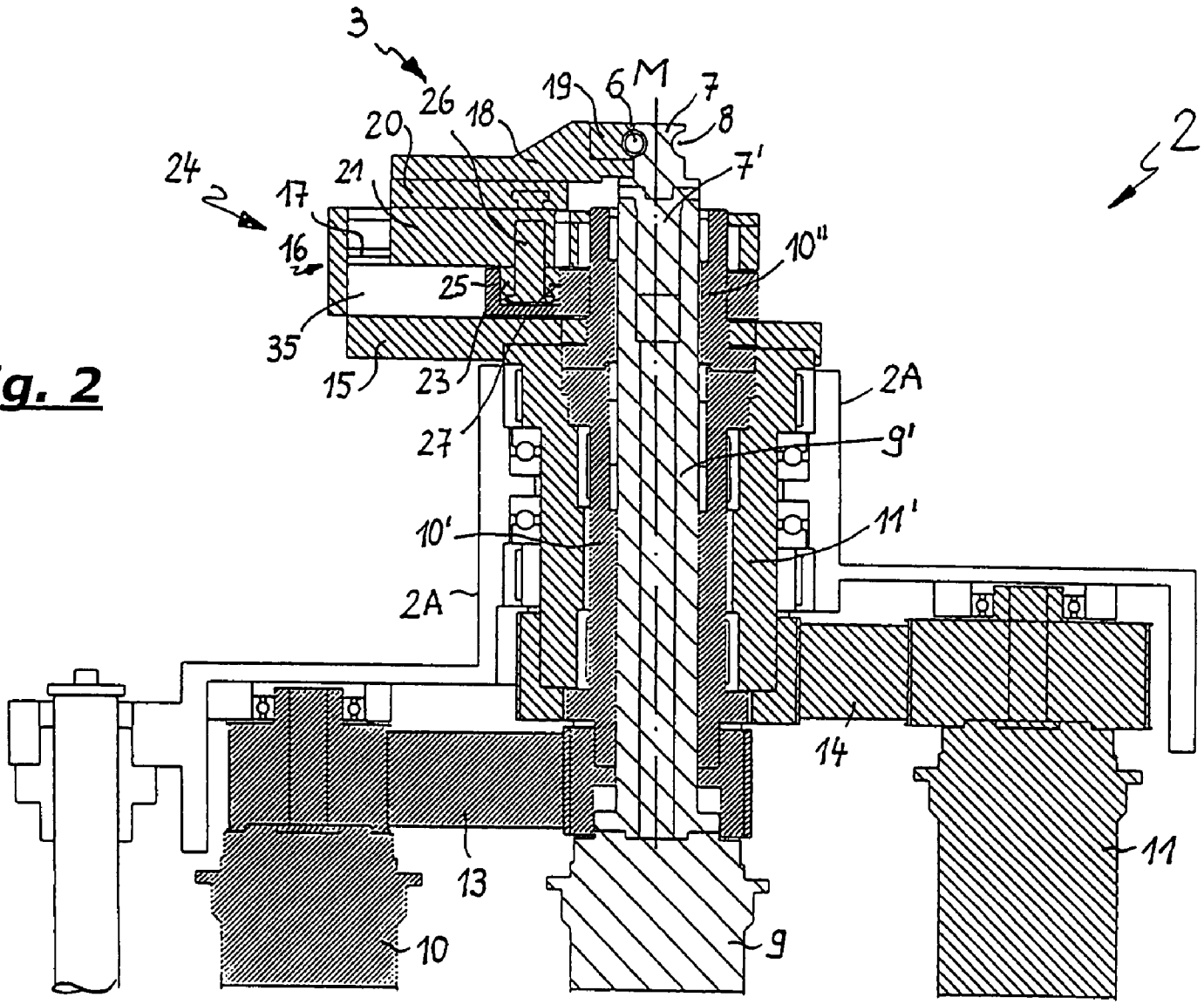
FIG. 2: a sectional representation (partially in principle) according to a position of the cutting plane perpendicular to the direction of feed of the workpiece to be processed, and through the common rotational axis of the three concentrically nested rotary shafts.

As can be seen from the cross section in FIG. 2 (showing a sectional view along a cutting plane that lies perpendicular to the longitudinal direction of the fed pipe 6 and runs through the rotational axis M of the bending mandrel 7), the carrier body 2A, shown in principle in FIG. 2 with only a single continuous line, includes an arrangement of three concentrically nested rotary shafts 9', 10' and 11' that are in the form of hollow shafts rotating inside one another. The three different hatchings in FIG. 2 portray the individual power transmission paths from the three rotary input drives 9, 10, 11 via the associated rotary shafts 9', 10', 11' to the parts to be rotated, whereby each hatching identifies the parts that belong to one drive train. The three rotary input drives 9, 10, 11 include a first, a second and a third rotary input drive.

Here each of the rotary shafts 9', 10' and 11' is driven by means of its own rotary drive 9, 10 and 11, whereby rotary drive 9 sits directly beneath the rotary shaft 9 for the bending mandrel 2, which [rotary shaft] is located centrally in the middle, the bending mandrel in turn being attached to the upper end of rotary shaft 9' with an intermediate tool holder 7' which is also only portrayed in principle. Rotary drive 9 directly drives rotary shaft 9', tool holder 7', and bending mandrel 7, which sits on the latter.

The middle shaft 10' of the concentric rotary shaft arrangement is driven at its lower end via a belt drive 13 by a rotary drive 10, and itself drives a disk cam 25 via a rotary flange 10" attached to it; the disk cam will be examined more closely below.

The outer rotary shaft 11' of the concentric rotary shaft arrangement is driven via a belt drive 14 by a rotary drive 11. Attached to its upper end is a rotatable supporting plate 15 to which a holding device 16 is attached and in which a linear guide 17 is formed, which—this will be examined later—allows the guidance of a linear motion in the direction of the position of bending mandrel 7 (or away from it) for a part that slides in the linear guide 17.

Assigned to the side of bending mandrel 7 is a tensioning block 18 (see FIGS. 1 and 2 and in particular the enlarged depictions in FIGS. 3 and 4), which has an interchangeable clamping jaw 19 on its side facing bending mandrel 7, in which (as can be seen especially well from FIG. 3) a forming groove 28 of a size corresponding to the shape of the pipe 6 is formed, facing the pipe 6 that is to be bent.

Tensioning block 18, with clamping jaw 19, is attached to a holding element 20, e.g. with screws that are not shown.

Figure 3:
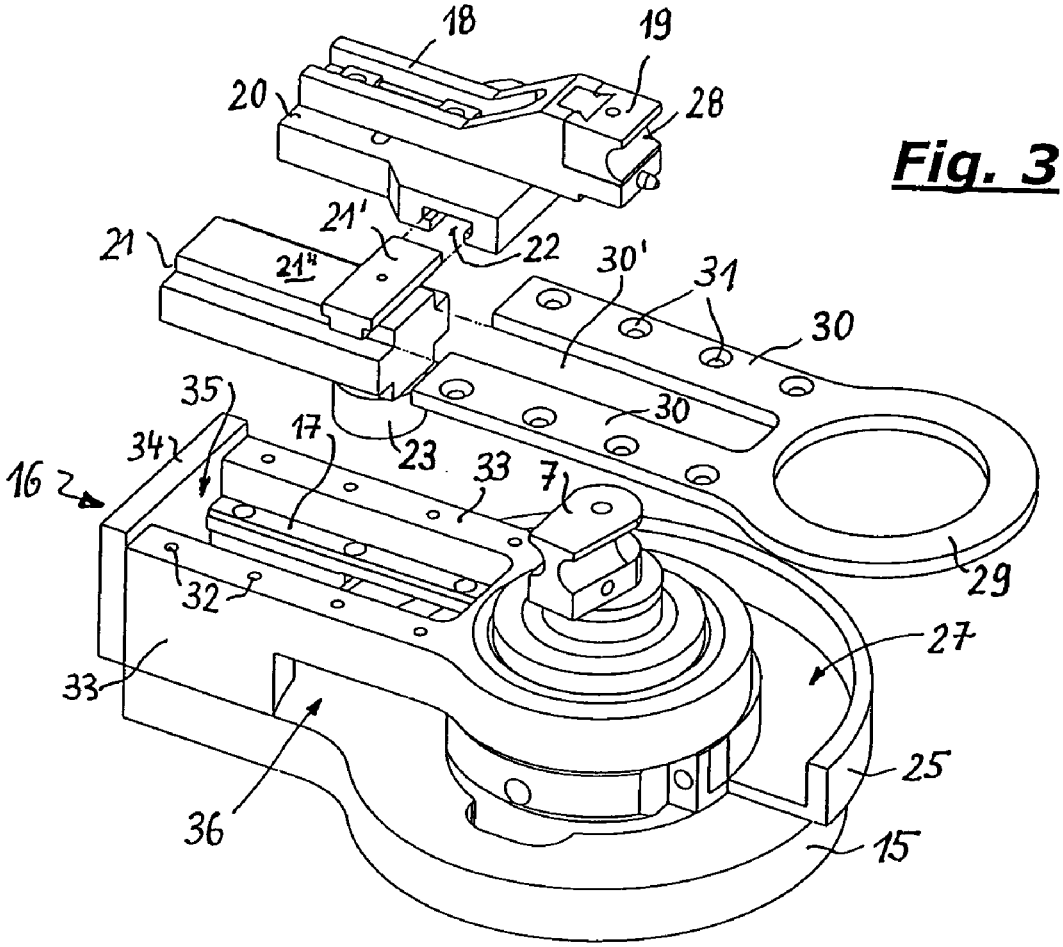
FIG. 3: an exploded perspective view of the upper section of the bending head on a bending apparatus according to the present invention.

Holding element 20 in turn sits on a carrier piece 21 in the manner that can be seen clearly from the exploded view in FIG. 3: on the underside of the holding element 20 is a T-shaped forming groove 22, open toward the bottom, that runs transverse to the direction of movement of the clamping jaw 18 and into which a tenon 21' mounted on top of the carrier piece 21 and having a corresponding T-shaped cross section can be inserted with positive fit. That makes it possible to slide holding piece 20 laterally on the carrier piece, transverse to the direction of motion of tensioning block 18, in order to be able to set a very specific position of tensioning block 18 relative to rotating mandrel 7.

Mounted on the underside of carrier piece 21 is a formed piece in the form of a rotatable roller 23 that protrudes there and engages a corresponding shaped groove 27 (see FIGS. 1 through 4). This roller 25 sits on a holding bolt 26 anchored in carrier piece 21 and can rotate freely.

Figure 4:
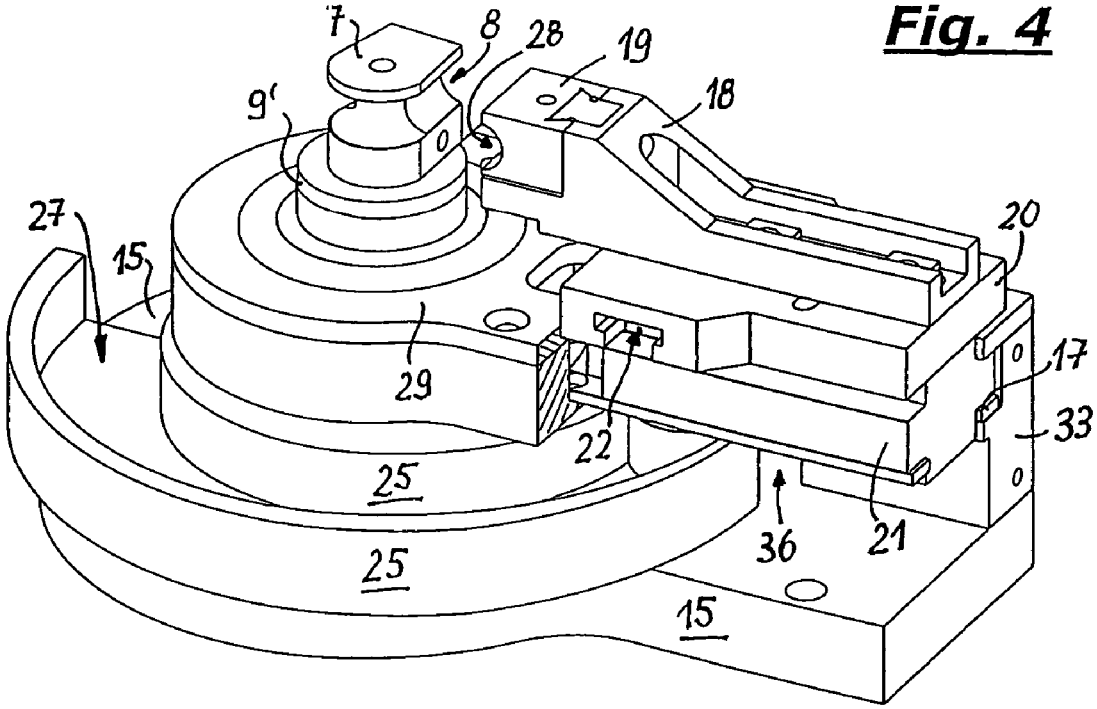
FIG. 4: the parts shown in FIG. 3 in the assembled state (in partial section)

In addition, carrier piece 21 is shaped such that it is guided on both of its sides by the linear or longitudinal guide 17 located there in holding device 16 and can be shifted in the longitudinal direction of the latter, as shown in particular by FIG. 2 and by FIG. 4, which shows a partially sectional view at that location.

When disk cam 25 is rotated by rotary drive 10 via belt drive 13 and rotary shaft 10', this means that the shaped groove 27 that is formed eccentrically on the disk cam 25 correspondingly shifts the roller 23 that engages it relative to the rotational axis M through the change in its rotational position, which leads via linear guide 17 to a corresponding shifting movement of holding element 20 and of tensioning block 18 mounted on the latter with its clamping jaw 19 in the direction of the rotary mandrel 7 or away from it.

Holding device 16 with the linear guides 17 mounted on it, cooperating with carrier piece 21, the rotatable roller 23 attached to the latter by means of holding bolt 26, and cam disk 25 with the eccentrically running groove 27 formed in it, cooperate to form a conversion transmission 24, turning the rotary motion of rotary shaft 10', whose purpose is to shift the clamping device 3, into a linear shifting motion of holding piece 21 (and thereby of the holding element 20 mounted on it and of the tensioning block 18 with clamping jaw 19). The fact that holding device 16 is attached to supporting plate 15 ensures that linear guides 17 in holding device 16 do not also turn when cam plate 25 rotates, if supporting plate 15 is not set in rotary motion itself. In this way, transmission of the rotary motion of cam plate 5 into a linear motion of carrier piece 21, and thus of clamping device 3 for clamping the pipe segment 6 or releasing it, is ensured. At the same time, it is possible to ensure that clamping device 3 presses pipe segment 6 against bending mandrel 7 with a desired or prescribed clamping force. In this condition, the bending procedure can then be undertaken, while keeping the tubular workpiece 6 clamped in place, to perform the bending procedure by rotating the cam plate 25 and the supporting plate 15 together.

As can be seen especially well from FIGS. 3 and 4, on top of holding device 16 sits a fork-shaped cover plate 29 that has a front section that is essentially round with a circular interior opening for placing it on the upper end of rotary flange 10", and emerging from this section two lateral arms 30 of the fork which extend in the longitudinal direction of holding device 16, each of which lies on top of a different side part 33 of holding device 16 and is attached to it by means of screws via holes 31 bored in these fork arms, for which there are matching holes 32 on the top of the side parts 33. The lateral fork arms 30 of cover plate 29 are somewhat wider than the respective top of a side part 33 lying below them, and with the free gap 30' between them form an additional longitudinal guide for a stepped upper shaped area 21" of carrier piece 21, so that the latter, when it moves longitudinally in the direction of bending mandrel 7 or back from it, is guided both by this gap 30' between the fork arms 30 and by the longitudinal strips of linear guide 17 that are mounted below it in the holding device 16. At its end that is turned away from rotary mandrel 7, holding device 16 has a connecting plate 34 that projects upward somewhat over the side parts 33, which closes off the internal space 35 that exists between the side arms 33 and the supporting plate 15, away from the direction of bending mandrel 7. At the same time, this connecting plate 34 also serves as an end stop for carrier piece 21, defining a maximum extended position.

As can also be seen from FIG. 3, on the underside of each side part 33 there is a cutout 36 that enables the cam disk 25 with the groove 27 formed on it to be passed through it between the particular side part 33 and the outer circumference of the rotary flange 10" when the cam disk 25 is rotated, as can be seen in detail from FIGS. 3 and 4, whose portrayal is explicitly referenced in this respect.

Figure 6:
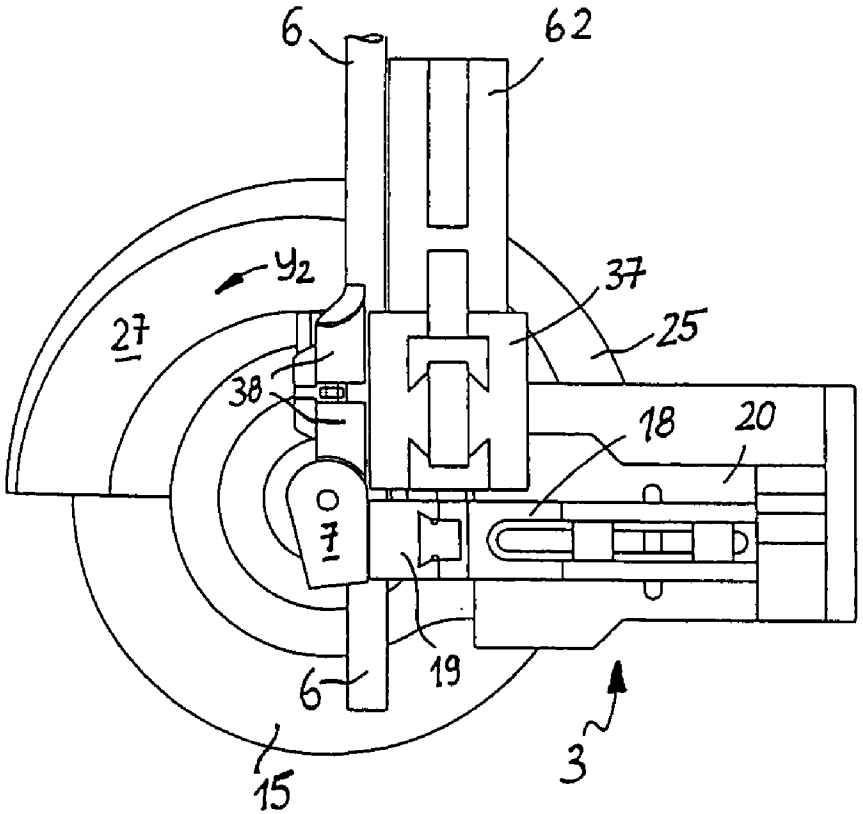
FIG. 6: the depiction from FIG. 5, but with the clamping device and wrinkle smoother in contact position.
Figure 5:
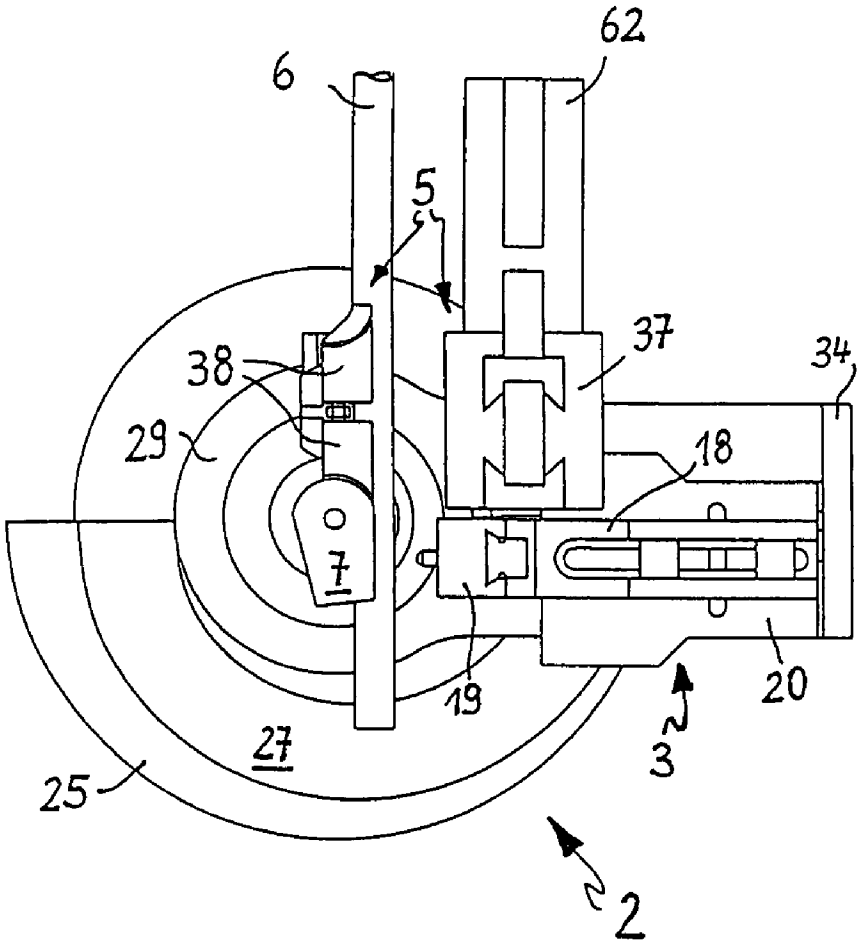
FIG. 5: a top view (in principle) of a bending head according to the present invention, with a pipe inserted.
Figure 7:
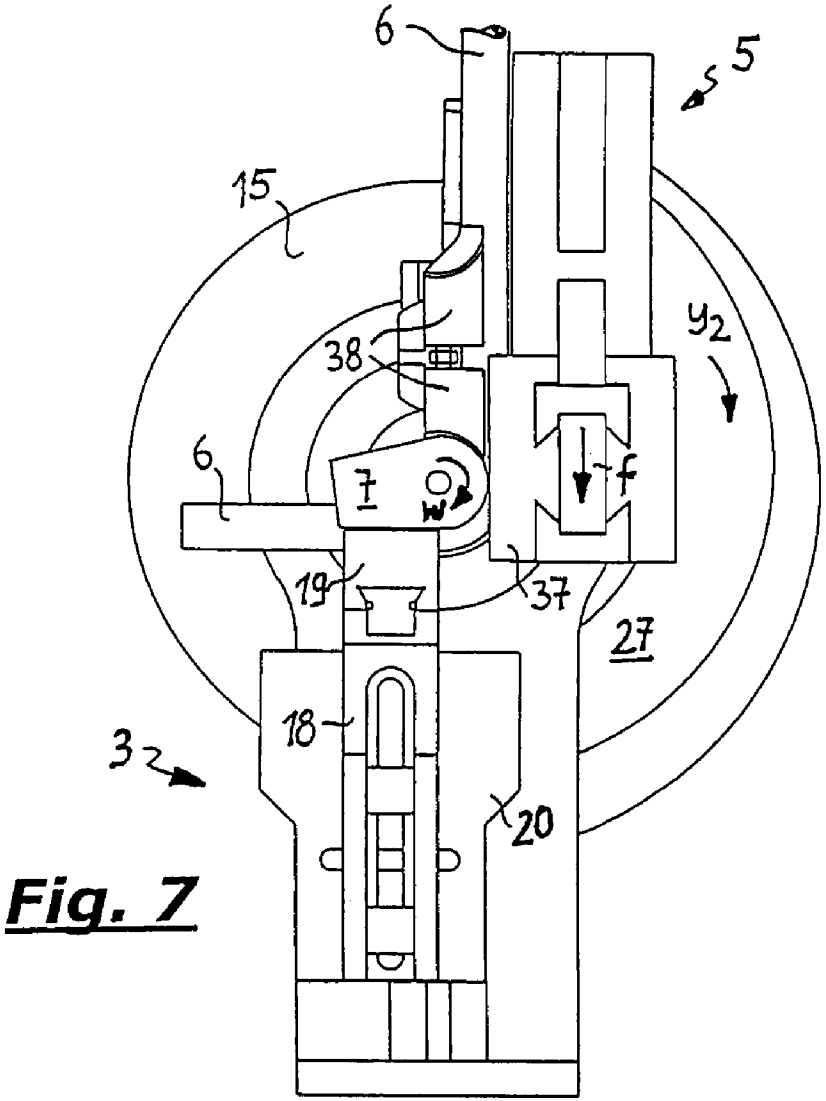
FIG. 7: the top view according to FIG. 6, but after the pipe has been bent by 90°.

FIGS. 5 through 7 now show in principle in a top view of the bending head from FIGS. 1 through 4, various sequences for producing a 90° bend in a prefabricated pipe 6 having thin walls.

FIG. 6 first shows the insertion position of bending device 1, in which bending mandrel 7 is placed with its forming groove 8 against the facing side of the fed-in pipe 6, while clamping head 3 is removed from bending mandrel 7 and pipe 6. From the wrinkle smoother 4, on the side where bending mandrel 7 is located, two guide jaws 38 that also have grooves 41 formed on them (FIG. 12) are likewise placed against the workpiece 6 in alignment with the forming groove 8 of bending mandrel 7, whereby each guide jaw 38 is attached by means of a screw 39 to an associated holder 40, as can be seen from FIG. 1.

On the opposite side of pipe 6, assigned to clamping jaw 38, there is a slip jaw 37 of wrinkle smoother 4, which, like clamping device 3, is withdrawn from the wire 6 in the insertion position, as shown in FIG. 5.

As FIG. 1 shows, slide rail 4 is mounted on bending head 2 and contains two spindle drives 60, 61, via which a plate 62 with slip jaw 37 can be positioned in a plane. Slide rail 4 is always positioned on the side of tensioning block 18 with respect to the axis of pipe 6. A slip jaw 37 is in contact with pipe 6. Depending on the application, slide rail 4 has different functions to perform during the bending procedure. It runs e.g. with pipe 8, draws it back, or pushes it forward, for example to prevent the formation of cracks in the raw material. In the exemplary embodiment shown in FIG. 1, slide rail 4 is also used to position the holding element 20 with tensioning block 18 and clamping jaws 19, as well as to rotate the holder 40 with the guide jaws 38 of wrinkle smoother 5.

The holder 40 of wrinkle smoother 5, with the guide jaws 38 attached to it, is attached to the slide rail 4 by means of pairs of linear guides 63. The linear guide pairs 63 are connected to one another via bridge 64. Wrinkle smoother 5 can be moved or repositioned by suitable means (not shown in detail) in the direction of the arrow F (FIG. 1), and can at the same time be rotated relative to the bending mandrel 7 (by means that are also not shown in detail). That makes it possible to ensure optimal adjustment of the wrinkle smoother 5 for both left-hand and right-hand bending.

In the insertion position shown in FIG. 5, if pipe 6 is placed against the facing forming grooves 8 and 41 (FIG. 12) of the rotary mandrel 7 and of the two guide jaws 38 of the wrinkle smoother 5, the clamping device 3 is then brought into contact with the side of pipe 6 that is opposite the rotary mandrel 7 by rotating the cam disk 25 in the direction of arrow $y_2$ and is rigidly clamped with a desired clamping force. This situation is shown in FIG. 6.

Then follows, as shown in FIG. 7, a rotation of bending mandrel 7 at the same time, in the same direction and at the same speed (in rotational direction w), and of supporting plate 15 (together with holding device 16) and of disk cam 25 in rotational direction $y_2$ (as indicated in FIG. 7) by 90°, whereby (by suitable means that are not shown) the slip jaw 37 of wrinkle smoother 5 is moved linearly further along with the pipe 6, in conformity with the feed velocity of the latter and in contact with it, in direction f shown in FIG. 7.

Through cooperation between bending mandrel 7 and clamping device 3, pipe 6 is bent by 90° in forming groove 8 in a circular end section 46 (see FIG. 11) of bending mandrel 7 (in the area of the latter around its rotational axis M), and then reaches an end position, as shown in FIG. 7. A right-hand bend is shown in FIG. 7.

FIGS. 8 through 11 now show, also in a top view like FIGS. 5 through 7, a bend in the opposite direction to that in FIGS. 5 through 7, namely a left-hand bend.

To this end, the bent pipe 6 is first held by a clamping jaw (not shown in FIG. 1) in the position that can be seen from FIG. 7. Next, by rotating the disk cam 25, the clamping jaw 19 is moved away from bending mandrel 7; slip jaw 37 of wrinkle smoother 5 is also moved linearly away from wire 6. Next pipe segment 6 is advanced sufficiently far, and at the same time rotated upward by 90° (in rotational direction d) so that the pipe end (already bent earlier) points vertically upward, as can be seen in the perspective representation in FIG. 12 (but already in the clamped state there).

Figure 8:
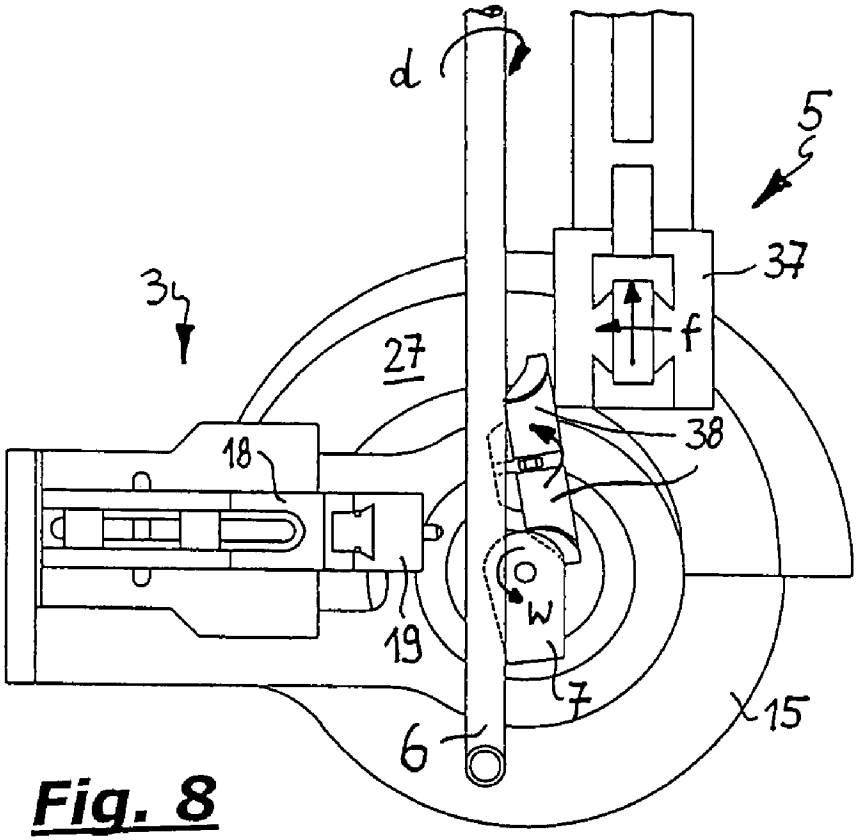
FIG. 8: a top view showing the principle of a bending head as in FIGS. 5 through 7, but here in the starting position for bending in the direction opposite that in the depictions in FIGS. 5 through 7 (with the pipe workpiece lying on top and the bending head moved down)

When pipe 6 is released, bending head 2 is withdrawn vertically downward (in direction b), so that bending head 2 with bending mandrel 7 lies entirely beneath the pipe 6 that protrudes from the clamping jaw, after which, as FIG. 8 shows, bending mandrel 7 is rotated away from the former bending direction in rotational direction w (as indicated in FIG. 8). The parts of the underlying bending head 2 covered by pipe 6 are sketched in only with dashed lines in FIGS. 8 through 10.

At the same time, the guide jaws 38 of wrinkle smoother 5 are also rotated in the direction shown by the arrow in FIG. 8, the slip jaw 37 having been retracted from the end position shown in FIG. 7 by a corresponding motion of slide rail 4 in the direction f shown in FIG. 8. The intermediate position thus attained is shown in FIG. 8.

Figure 9:
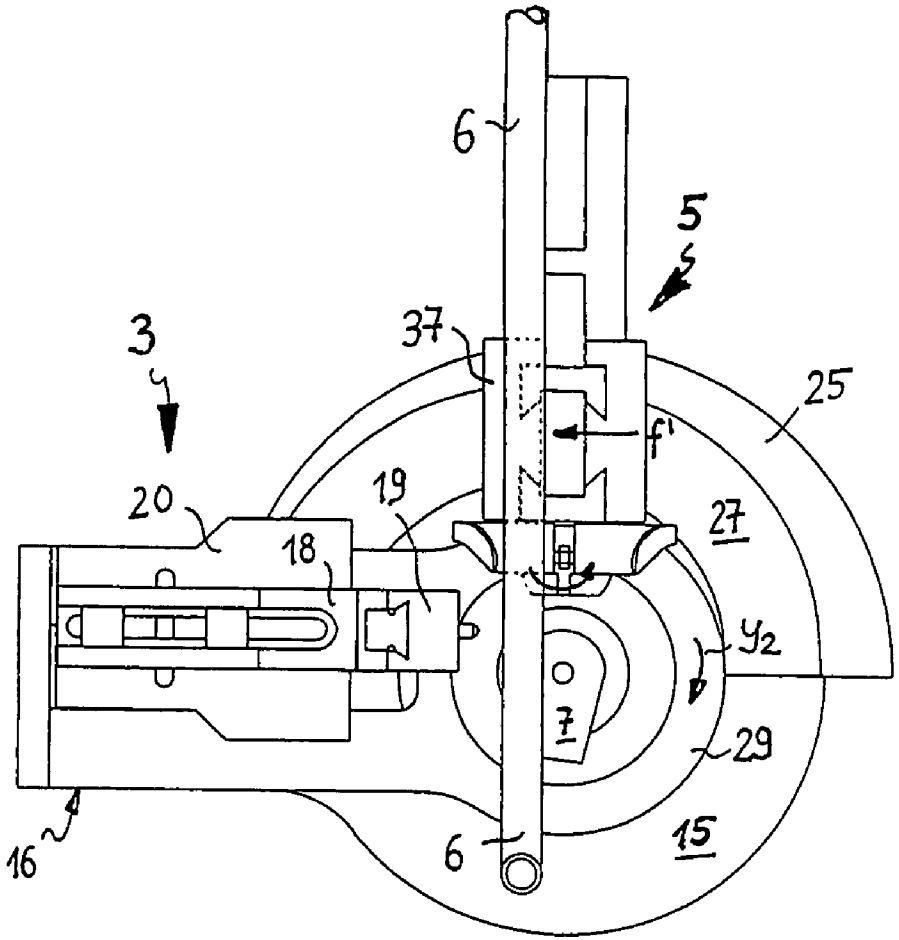
FIG. 9: the depiction from FIG. 8, with the slip jaw of the wrinkle smoother moved to the other side and its guide jaws rotated.

FIG. 9 shows an additional operational step in which, with bending head 2 still positioned beneath the pipe segment 6, the clamping device 3 from FIG. 5 is now brought to a position 180° opposed, by rotating the supporting plate 15 (with the holding device 16 and the clamping device 3 mounted on it) and the disk cam 25 by 90° (in rotational direction $y_1$) jointly, with equal speed and in the same direction.

In addition, the guide jaws 38 of wrinkle smoother 5 are rotated further counter-clockwise (in FIG. 9), and likewise slip jaw 37 is also moved in the direction of arrow f' to the other side of pipe 6. This intermediate position can be seen from FIG. 9.

Figure 10:
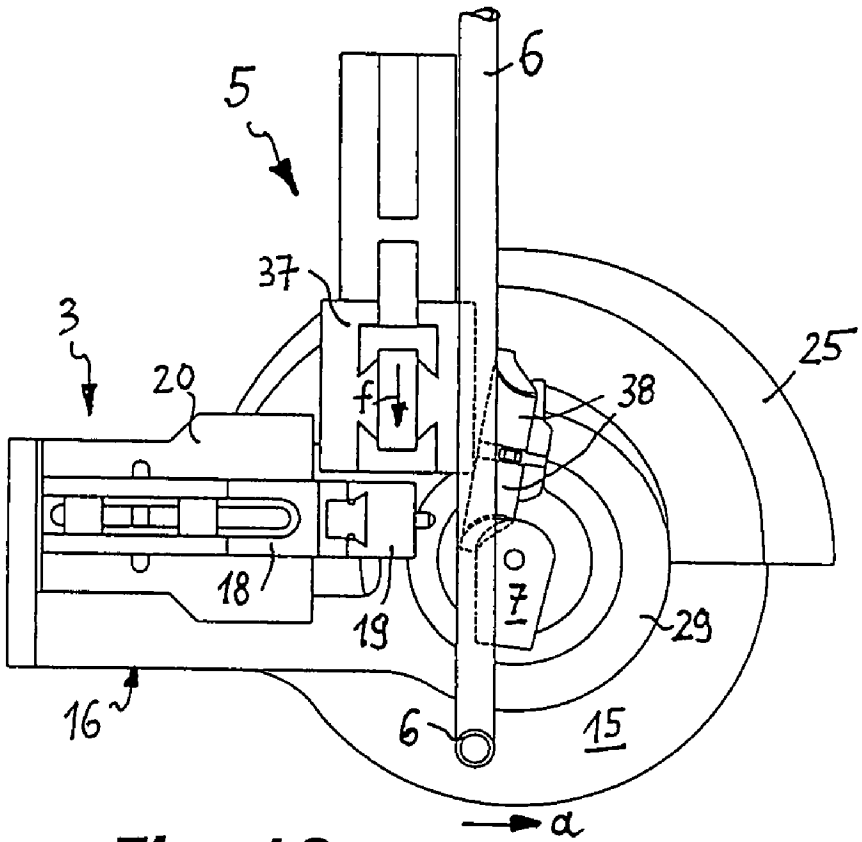
FIG. 10: the depiction from FIG. 9, but with the slip jaw of the wrinkle smoother repositioned to the final lateral position on the opposite side and its guide jaws rotated by nearly 180°.

FIG. 10 shows the position that is reached when slip jaw 37 together with clamping device 3 is brought to a position that corresponds to the position in FIG. 5, but where all the elements are on the side of pipe 6 opposite the position in FIG. 5.

Figure 11:
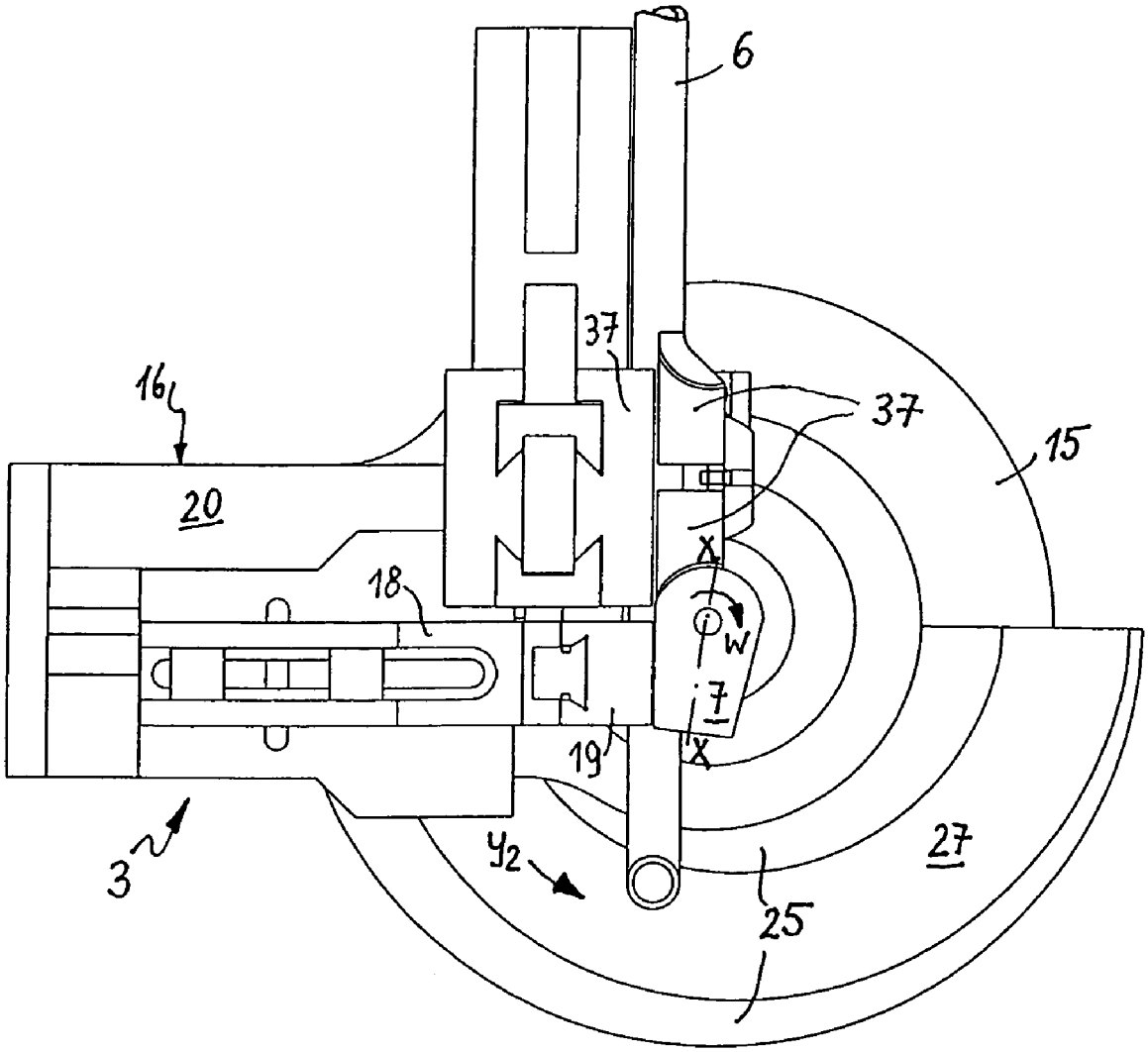

Finally, FIG. 11 shows the starting positions of pipe 6, clamping device 3, bending mandrel 7 and wrinkle smoother 5 relative to each other for a left-hand bend, corresponding in principle to the starting position for the bending procedure that corresponds to the position in FIG. 6 for right-hand bending. Here slip jaw 37 has been moved from the intermediate position shown in FIG. 10 somewhat further away from pipe 6, so that there is once again on the whole an open insertion position for pipe 6. Next bending head 2 is again moved upward (in direction b (from FIG. 1)), and together with bending mandrel 7 and slip jaw 37 of wrinkle smoother 5 is then placed in contact with the one side (in FIG. 11 the right side) of pipe segment 6, bending mandrel 7 already having been rotated with its forming groove 8 that faces pipe 6 aligned with the longitudinal axis of pipe 6. Next, by rotating the disk cam 25 accordingly, the tensioning block 18 of clamping device 3 is placed with clamping jaw 19 against the other side of pipe 6, and accordingly slip jaw 37 is also brought into contact with pipe 6 with its forming groove 41 likewise on this side. Thus the starting position (clamped position) of pipe 6 shown in FIG. 11 is attained, from which a corresponding left-hand bend can be produced by simultaneously rotating bending mandrel 7, clamping device 3 and disk cam 25 by 90° (counter-clockwise in FIG. 11).

The starting position attained in FIG. 11 before the bending process (to the left) is shown once more in FIG. 12 in a perspective view of the bending device from above.

With regard to the shape of bending mandrel 7, as it is employed in the embodiment according to FIGS. 1 through 11, reference is made once more to the portrayal in FIG. 11:

In the top view, bending mandrel 7 is not rotationally symmetrical, but it is mirror-symmetrical about a central plane X-X ("axis of symmetry") that runs through its axis of rotation (corresponding to the axis of rotation M of the three nested rotary shafts 9', 10' and 11'). The forming groove 8 formed on bending mandrel 7 runs along the two longitudinal sides of the bending mandrel 7 shown in FIG. 11 and in the zone 46 in which its ends are joined to one another via a circular path, so that the forming groove 8 runs continuously over a total of three sides of bending mandrel 7, with its own shape symmetrical to the central plane X-X. This means that the utilized bending mandrel 7 is able to work with only a single shaping groove 8, and that it is not necessary to utilize different forming grooves, let alone at different axial heights of bending mandrel 7.

FIGS. 13 and 14 once again show oblique perspective views of the principle of two other versions of a bending head 2:

The embodiment according to FIG. 13 achieves an especially compact construction, but this configuration is only recommended if there is no danger of cracking or wrinkling in the pipe to be bent, so that the slide rail 4 and the wrinkle smoother 5 are unnecessary.

In the embodiment according to FIG. 13, the slip jaw 37 of wrinkle smoother 5 is replaced by a guide roller 42 that is mounted so that it can rotate freely and guides the pipe that is to be bent before it enters the forming groove 8 of bending mandrel 7.

In the embodiment shown here, bending mandrel 7 comprises in principle a bending roller, which however does not have a complete circular circumference, but in which part of the circumference of the circle is cut away, as shown by FIG. 13, to which reference is made.

In this embodiment the clamping device 3 includes a clamping jaw 43 that is held by a holding device 44 portrayed in FIG. 13 only in principle (shown in FIG. 13 in the form of a pin), that is formed in a radially running slot guiding device 45 (in the form of an elongated hole) in supporting plate 15. This holding device 44 is guided beneath support plate 15, e.g. in an eccentric guide groove (not visible) that passes around the central axis M of rotating head 2 for moving the clamping jaw 43 relative to the pipe 6. This eccentric forming groove (not shown in detail in FIG. 13) can be attached on the top of a plate or the like that is rotatable about the central axis M but is located beneath the supporting plate 15 and which for its part is rotatable via the middle rotary shaft 10' of the three nested rotary shafts 9', 10', 11' for producing a shifting movement of the clamping jaw 43. A more detailed description of the special mechanism for this is not necessary, however, since the person skilled in the art is familiar with the design of such a rotary guide for shifting the movement of holding device 44. In other respects it functions by the same principle as the forming groove/roller arrangement according to FIG. 1.

The additional embodiment of a bending head 2 portrayed in FIG. 14 differs from the other embodiments described earlier in particular in that here, instead of the slip jaw 37, two guide rollers 47, 48 are provided for lateral contact against the pipe 6 that is to be bent and are positioned upstream of the tensioning block 3 (viewed in the transport direction c of the pipe 6).

On clamping head 3, clamping jaw 19 is also no longer provided with a guide groove, as in the embodiments in the previous figures, but with a bending roller 49 with which the desired shaping of pipe 6 can be carried out.

In this embodiment the bending mandrel is designed as a bending roller 50 with a circumferential forming groove to be placed in contact with the pipe segment 6.

The movement of the clamping device 3, the rotation of the bending mandrel 50, and the positioning and tracking of the wrinkle smoother 5 are accomplished in the same way as with the embodiments according to FIGS. 1 through 13, through corresponding program control of the three utilized rotary drives 9, 10 and 11, which act on three concentrically nested rotary shafts 9', 10' and 11' on the parts to be moved, as already shown in principle in the sectional depiction in FIG. 2.

The present invention may be embodied in other specific forms without departing from the central attributes thereof, therefore, the illustrated embodiments should be considered in all respects as illustrative and not restrictive, reference being made to the appended claims rather than the foregoing description to indicate the scope of the invention.

The invention claimed is:

1. A machine for bending rod-shaped or tubular work pieces, comprising:

a bending head having a bending mandrel mounted on a rotational axis and rotatable by a rotary drive;

a clamping device for pressing the work piece to be bent against a first forming groove on the bending mandrel;

a feeding device for the work piece to be processed, whereby the clamping device is positionable relative to the bending mandrel and is also pivotable concentrically to the rotational axis of the bending mandrel, wherein the clamping device is attached to two mutually independent rotary drives, including a first rotary drive which pivots the clamping device about the rotational axis of the bending mandrel, and a second rotary drive which moves the clamping device with respect to the bending mandrel by using an interposed conversion transmission that converts a rotary motion to a linear motion, whereby the bending head includes three concentrically nested rotary shafts, including an innermost rotary shaft, a middle rotary shaft and an outer rotary shaft, to transmit rotary motion from a first a second and a third rotary input drives to the bending mandrel, to the conversion transmission and to the clamping device respectively.

2. The bending apparatus as recited in claim 1, wherein the innermost rotary shaft carries the bending mandrel, which is mounted at the top of the bending head.

3. The bending apparatus as recited in claim 2, wherein the middle rotary shaft drives the conversion transmission, which is mounted on the bending head beneath the bending mandrel, for linear motion of the clamping device.

4. The bending apparatus as recited in claim 3, wherein the outer rotary shaft is connected to a support plate mounted beneath the conversion transmission, and the clamping device is mounted on the support plate such that the clamping device can shift in a direction perpendicular to a central axis of the three concentric rotary shafts.

5. The bending device as recited in claim 1, wherein the conversion transmission comprises a disk cam with a groove formed therein, the groove being eccentric to the disk cam's axis of rotation, and the groove being engaged by a formed piece that conforms to a cross section of the groove, the formed piece being attached to the clamping device and being shiftable in the groove and whose distance from the axis of rotation of the disk cam can be changed by turning the disk cam.

6. The bending device as recited in claim 5, wherein the clamping device comprises a holding element affixed to the disk cam so that the clamping device and the holding device rotate together and a tensioning block that is slidable in a linear guide that is mounted on the holding device, and to which the formed piece that engages the groove in the disk cam is attached.

7. The bending device as recited in claim 6, wherein the tensioning block comprises an interchangeable attached clamping jaw, presenting a second forming groove that corresponds to the position of the first forming groove in the bending head and that matches the shape of the work piece that is to be clamped.

8. The bending device as recited in claim 6, wherein the tensioning block is attached to a holding element that carries the formed piece, and the holding element engages the linear guide.

9. The bending device as recited in claim 8, wherein the holding element in turn sits on a carrier piece to which it is attached so that it can be shifted relative to the linear guide, and on which the formed piece is mounted so that it has a sliding engagement with the linear guide.

10. The bending device as recited in claim 9, wherein the holding element is driven on the carrier piece so that it can be moved.

11. The bending device as recited in claim 1, further comprising a wrinkle smoother immediately upstream of the clamping device.

12. The bending device as recited in claim 11, wherein the wrinkle smoother comprises slip jaws that can be placed in contact with the work piece that is to be bent.

13. The bending device as recited in claim 1, in which the first, second and third rotary input drives are programmably controlled.

14. The bending device as recited in claim 1, in which the bending head is movable in two directions that are perpendicular to each other and both of which are perpendicular in turn to the feed direction of the work piece to be bent.

15. The bending device as recited in claim 1, further comprising, a fixed guide roller for the work piece on the side of the work piece where the clamping device.

16. The bending device as recited in claim 7, wherein the bending mandrel and the clamping jaw of the tensioning block both designed comprise a roller with a guide groove to be placed against the work piece to be bent.

17. The bending device as recited in claim 11, wherein the wrinkle smoother comprises at least two pressure rollers arranged in sequence in the feed direction of the work piece to be bent.

18. The bending device as recited in claim 1, wherein the bending mandrel, viewed parallel to its pivoting axis, has a shape that is not rotationally symmetrical, but is symmetrical to a central axis that is perpendicular to the axis of rotation and passes through it, and wherein the forming groove on the bending mandrel, for contacting one side of the work piece to be bent, viewed relative to the longitudinal central axis, is also positioned symmetrically on both sides of the bending mandrel.

* * * * *